US006550376B2

(12) United States Patent
Johnston

(10) Patent No.: US 6,550,376 B2
(45) Date of Patent: Apr. 22, 2003

(54) TWIN SCREW PRESS WITH INTERRUPTED FLIGHTS

(76) Inventor: Robert Boyd Johnston, 2810 5th Ave., Tampa, FL (US) 33605

( * ) Notice: Subject to any disclaimer, the term of this patent is extended or adjusted under 35 U.S.C. 154(b) by 49 days.

(21) Appl. No.: 09/766,970

(22) Filed: Jan. 23, 2001

(65) Prior Publication Data

US 2002/0096062 A1 Jul. 25, 2002

(51) Int. Cl.[7] ..... B30B 3/04; B30B 9/18

(52) U.S. Cl. ..... 100/146; 100/150; 100/126; 100/117

(58) Field of Search ..... 100/117, 126–129, 100/146, 148, 149, 150

(56) References Cited

U.S. PATENT DOCUMENTS 647,354 A 4/1900 Anderson
3,003,412 A * 10/1961 Vincent ..... 100/117
3,144,818 A * 8/1964 Sullivan ..... 100/117
3,892,173 A * 7/1975 Hall et al. ..... 100/117
4,214,947 A * 7/1980 Berger ..... 100/146
4,581,992 A 4/1986 Koch
5,137,489 A 8/1992 Boster
5,205,930 A 4/1993 Obrestad
5,417,155 A * 5/1995 Tatsuzawa et al. ..... 100/112
5,743,178 A * 4/1998 Babbini ..... 100/127

* cited by examiner

*Primary Examiner*—Allen Ostrager
*Assistant Examiner*—Jimmy T Nguyen

(57) ABSTRACT

A screw press with twin screws is provided with discontinuities or interruptions 7 in the flighting 8 of the screws 2. Stationary resistor teeth 9 protrude at these interruptions into the flow of material being pressed.

1 Claim, 2 Drawing Sheets

TWIN SCREW PRESS WITH INTERRUPTED FLIGHTS

BACKGROUND OF THE INVENTION

The present invention relates to an improvement in a screw press, specifically to the configuration of the screws used in a twin screw press.

Screw presses have been used for centuries. Common applications are extracting juices and dewatering fibrous materials. Basically a screw press is a machine in which a helicoid screw rotates inside a cylindrical perforated screen. Entering material is subjected to gradually increasing pressure as it moves toward the exit end of the press, forcing the liquid phase to expel through the screen.

Compression is generally achieved in a screw press by a combination of three features: (a) the diameter of the shaft of the screw is increased, forcing material against the screen; (b) the pitch of the flights of the screw is reduced, compressing the material; and (c) back-pressure is created within the screen chamber by use of a cone (door, choke, plate, stopper or plug) located at the cake discharge end of the press.

A major innovation in screw press design was patented in 1900 by Valerius D. Anderson. His U.S. Pat. No. 647,354 describes how interruptions can be made in the flighting of the screw. This results in improved performance on slippery or slimy materials such as spent brewers' grain, orange peel, fish, and rendering offal. The use of screw presses with interrupted flights rapidly came to dominate in these applications.

Flighting is the helicoid (corkscrew) surface that wraps around the shaft of a screw, somewhat like threads on a rod.

An improvement to the Anderson design was the addition of stationary resistor teeth. These are mounted, fixed to the frame of the machine, so that they protrude through the screen at the locations where the screw flighting is interrupted. The teeth are in the flow of material passing through the press. They can range in length from very short to reaching almost to the screw shaft. They cause stirring which both reduces co-rotation (slippage) tendency and puts wet material against the screen.

The l/d ratio is the ratio of screw diameter to screen length. Short l/d ratios, compared to those of continuous screw presses, are typical of interrupted flight machines.

A weakness of the single screw press is that, lacking positive displacement, excessive slippage can occur in the press. Thus difficult (slimy) materials can tend to co-rotate with the screw, resulting in a loss of both throughput and dewatering capacity. The amount of compression that can be applied to a material is limited by its tendency to slip, even in interrupted screw machines.

In recent decades another type of screw press has been found to offer stronger dewatering performance. This is a double (twin) screw press that features a pair of overlapping screws mounted side-by-side. Since the screws have continuous flighting, relatively positive displacement is created. This
semi-positive displacement, combined with optional features such as increasing shaft diameter, tightening pitch, and discharge back-pressure, result in a tighter squeezing press.

The principal disadvantage of the conventional twin screw press is that it requires (a) constant flow of (b) consistent material. If the solids consistency of the feed material decreases, this sloppy material will purge from the discharge of the press. A similarly bad situation occurs if the consistency increases: excessive dewatering occurs and the press jams or locks on a solid mass of cake. Screw and gearbox failures can result when this occurs.

Because of their heavy pressing action these continuous flight presses characteristically require high torque and rigidity, which results in large gearboxes, shafts, bearings, and flighting. These characteristics put conventional twin screw presses at a cost disadvantage.

In a continuous flight screw press there is almost no stirring action within the press. This is true even with twin screw designs. "In at three o'clock, out at three o'clock," is how they are described. A disadvantage of this is that high l/d ratios are required in order to allow enough time for liquid in the material against the screw shaft to migrate to the screen surface. A higher l/d ratio results in a longer, more costly machine than one with a low l/d ratio.

SUMMARY OF THE INVENTION

The object of the subject invention is to gain, in one machine, the respective advantages of interrupted flight screw press and twin screw presses. The invention combines the high capacity and low horsepower, relative to size, of the interrupted screw press, along with the strong, positive throughput and dewatering features of the twin screw press.

The subject invention uses twin overlapping interrupted flight screws with stationary resistor teeth mounted at the interruptions. The interruptions and teeth stir the material being pressed, which has the effect of both reducing co-rotation and placing fresh, wet material against the screen surface. Thorough dewatering is achieved with the low l/d ratios typical of interrupted screw presses.

The use of twin overlapping screws achieves a degree of positive displacement, resulting in tight squeezing and a great reduction in slippage. This improves dewatering of slimy materials. On the other end of the scale, there is enough give to the interrupted configuration that jamming is minimized. In addition it has been found that slicing action resulting from the interruptions in the screw flighting reduces the torque (horsepower) requirement for proper dewatering.

Figure 1:
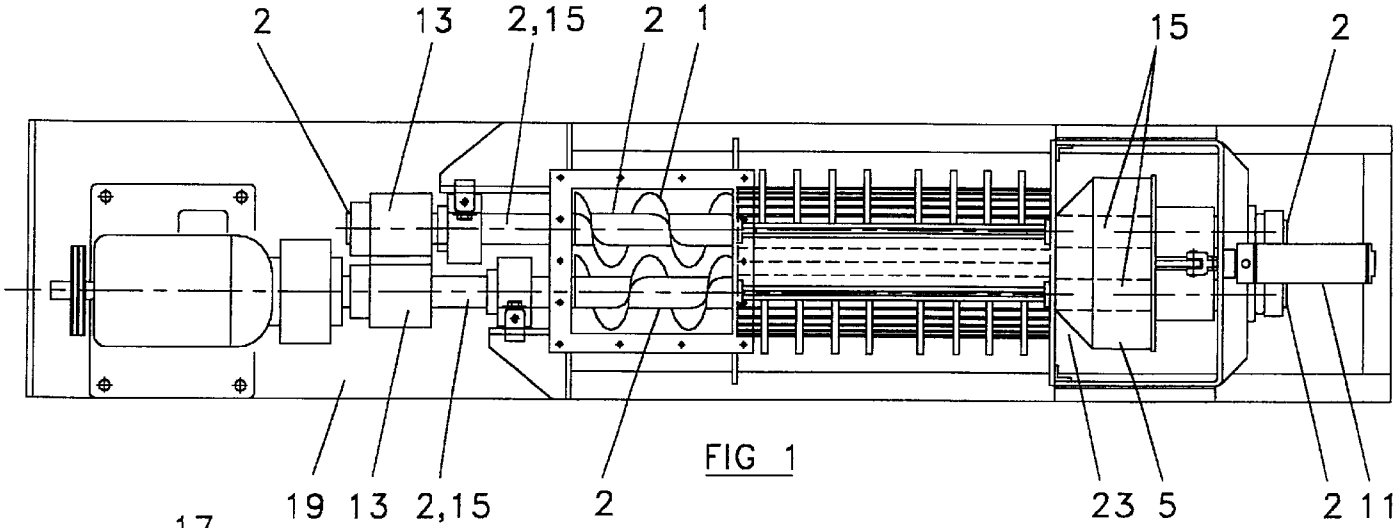
FIG. 1 shows a schematic top view of a twin screw press. The overlapping screws 2, with continuous feeder flighting 1 in the inlet hopper 21, and a discharge cone 5 are illustrated.
Figure 2:
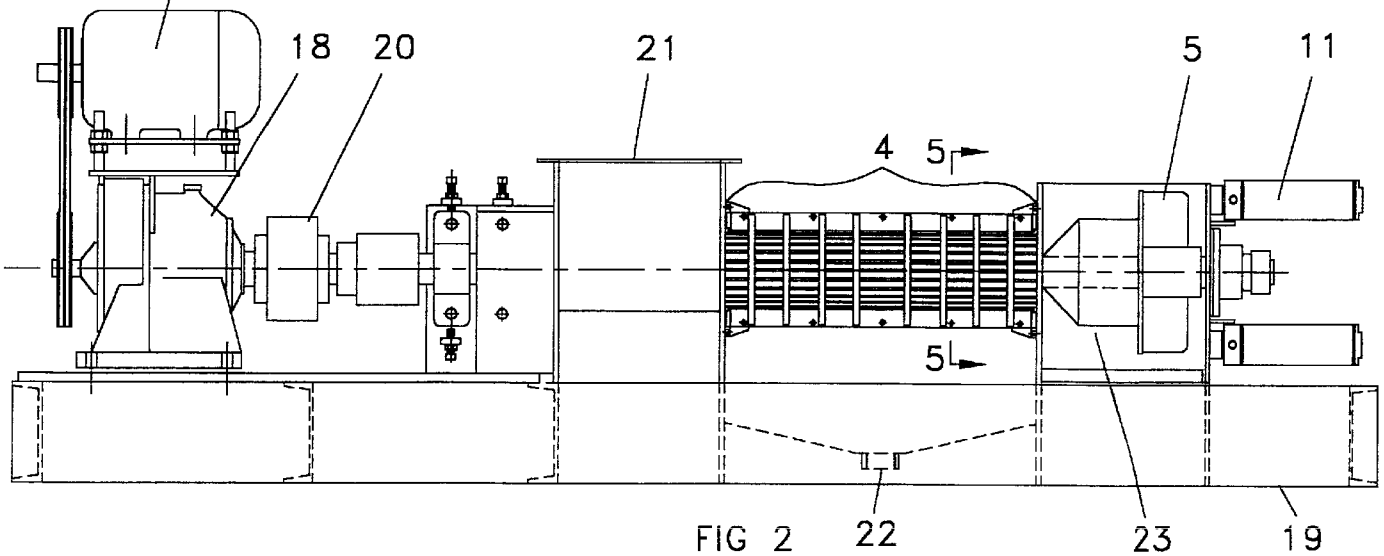
FIG. 2 shows a side view of the same screw press. The motor 17 is seen driving the gearbox 18. The gearbox is mounted on the frame 19 of the screw press. Through one or two shaft couplings 20 the gearbox drives the screws 2. Material is feed into the press through the inlet hopper 21. Press liquor drains from drain 22 while press cake falls from the cake discharge 23.

Additional screen areas may be provided both in the inlet hopper of the screw press and on the face of the discharge cone. Screens are typically made of punched sheetmetal, drilled plate, and profile bar (wedgewire). The type of screening and screen opening is not material to this patent.

DESCRIPTION OF THE INVENTION

With reference to the accompanying drawings, there is shown a screw press with twin overlapping screws 2 with interrupted compression flights 8 and fixed resistor teeth 9.

As shown in the figures, material is fed into the feeder portions 1 of the screws 2 through an inlet hopper 21. This material is fed from the inlet hopper into the main screen chamber 4 where the dewatering occurs. Expelled liquid (press liquor) drains through screen 14 to a collection pan 12, while dewatered material (press cake) discharges past a restraining cone 5 at the solids discharge end.

Figure 3:
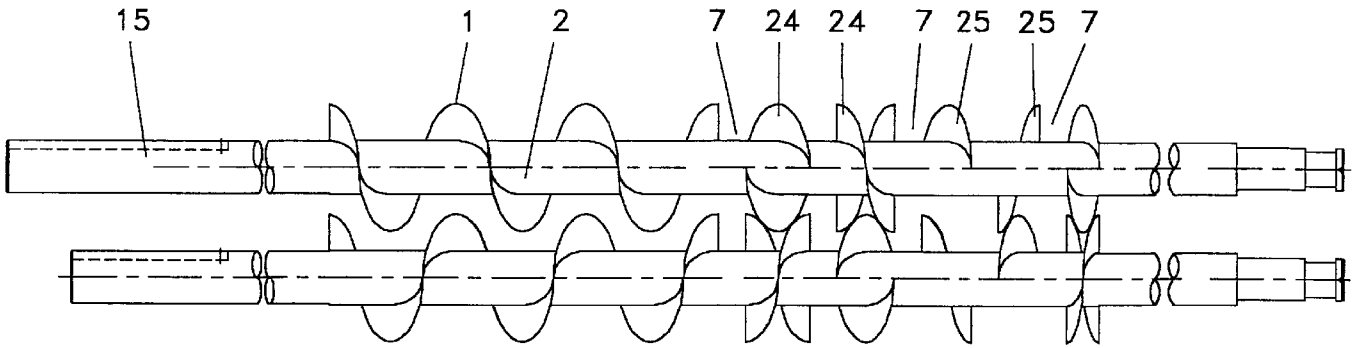
FIG. 3 shows a side view of a pair of typical interrupted flight screws 2. The shafts 15 have continuous flighting in the inlet area of the press; this serves to feed material into the screened compression portion of the screws. The flighting becomes interrupted to allow spaces 7 for the insertion of resistor teeth 9. The flighting 8 of the compression stages can be double flighted 24 or single flighted 25.
Figure 5:
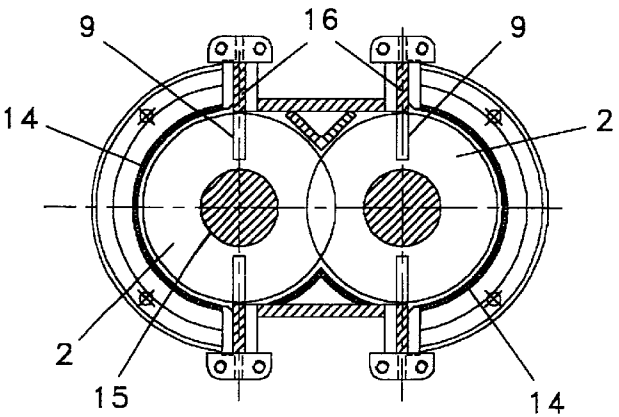
FIG. 5 shows a sectional end view through the screen area of the press. The screws 2 with their shafts 15 are shown overlapping within the screens 14. Resistor teeth 9 are shown, top and bottom, protruding into the flow stream of the press. The resistor teeth are shown mounted in a typical arrangement using support bars 16.
Figure 4:
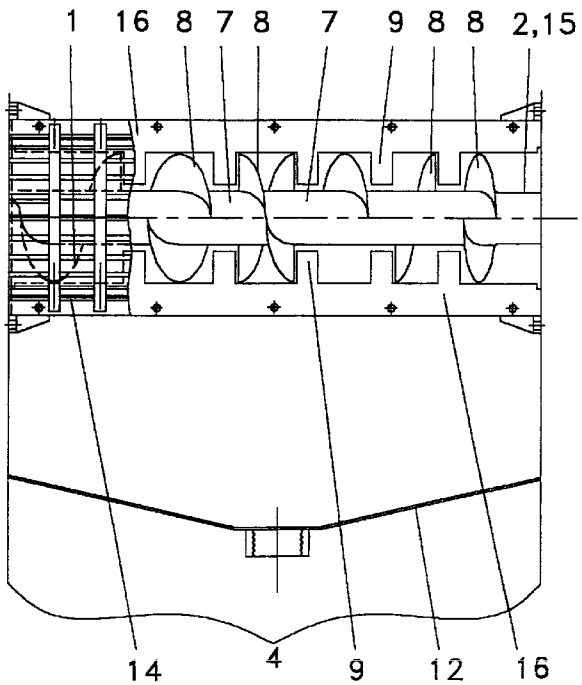
FIG. 4 shows a sectional side view through the main screen area 4 of the press. The fixed resister teeth 9, positioned in the gaps 7 between the compression flights 8, are illustrated.

Screws 2 consist of helicoid flighting 1 and 8 mounted on shafts 15. As shown in FIGS. 3 and 5, the screws 2 overlap each other. These are driven in opposite directions of rotation in order to progressively move material through the press. The flights on one screw are right hand, while the other screw is left hand. The amount of overlap, from near zero to where the flights of one screw almost hit the shaft of the other, is varied by application requirements.

Furthermore, the screws must be driven in a synchronized manner in order to prevent mechanical interference. Normally this is achieved with the use of either a twin output gear box or, as illustrated, separate spur gears 13 mounted on the screw shafts.

The figures show a screw press in a horizontal configuration. Vertical configurations, with material flowing either upward or downward, can also be employed. The pressing action remains essentially the same.

The figures show a screw press with five stages of compression with resistor teeth on two sides of each screw. From three to seven stages of compression are typical in production machines. Also, resistor teeth can be placed on only one side of a screw or on only one of the two screws.

The position of restraining cone 5 is shown automatically adjusted by means of a pneumatic cylinder 11. Springs, bladders, counterweights, and hydraulic cylinders can also be used to provide automatic adjustment of back pressure during press operation. The discharge cone need not be conical: flat and pyramid configurations are also used.

While the present invention has been described with respect to certain preferred embodiments, it is to be understood that the invention is not limited thereto, but rather is susceptible of numerous changes and modifications which will occur to those skilled in the art. Consequently, the present invention is not to be limited to the details shown and described herein, but is intended to cover all such changes and modifications as are encompassed by the scope of the appended claims.

What I claim as my invention is:

1. A twin-screw liquid expeller screw press comprising:

a frame defining a material flow passage, said frame having an upstream and downstream end;

an inlet opening for receiving material at said upstream end;

an outlet opening for discharge of solids from said screw press at said downstream end of said frame;

two parallel counter-rotational screw shafts mounted horizontally within said frame, wherein said screw shafts are mounted side by side in parallel relation to the bottom of said frame, one of said screw shafts having left hand fighting, the other of said screw shafts having right hand fighting, said flightings overlapping each other;

a plurality of interruptions on each fighting, each interruption forming a gap in its fighting, each gap being partially filled with one of a plurality of stationary resistor teeth, said teeth being connected to the frame and protruding radially into said gap and said material flow passage;

a filtering element for filtering liquid from said material, wherein said filtering element surrounds a portion of a length of said screw shafts;

means for draining liquid expressed through said filtering element;

a solids discharge restricting device, mounted adjacent to said outlet opening; and means for automatically adjusting said position of said discharge restricting device during pressing operation to discharge solids, wherein the screw shafts are driven to move the material along the material passage from said inlet opening to said outlet opening.

* * * * *